US010443990B2

(12) United States Patent
Yadon

(10) Patent No.: US 10,443,990 B2
(45) Date of Patent: Oct. 15, 2019

(54) FRAGMENTING SHOTGUN PROJECTILE WITH RADIALLY-DISPOSED SEGMENTS

(71) Applicant: Connor Yadon, Kaysville, UT (US)

(72) Inventor: Connor Yadon, Kaysville, UT (US)

( * ) Notice: Subject to any disclaimer, the term of this patent is extended or adjusted under 35 U.S.C. 154(b) by 0 days.

(21) Appl. No.: 15/618,110

(22) Filed: Jun. 8, 2017

(65) Prior Publication Data

US 2018/0356193 A1 Dec. 13, 2018

(51) Int. Cl.
*F42B 14/06* (2006.01)
*F42B 7/10* (2006.01)

(52) U.S. Cl.
CPC ..... *F42B 7/10* (2013.01)

(58) Field of Classification Search
CPC ..... F42B 7/10; F42B 8/12; F42B 8/14; F42B 12/24; F42B 12/28; F42B 12/34; F42B 12/58; F42B 12/60; F42B 14/02; F42B 14/06; F42B 14/061; F42B 14/062
See application file for complete search history.

(56) References Cited

U.S. PATENT DOCUMENTS 3,058,420 A * 10/1962 Tanner ..... F42B 7/10 102/439
3,164,092 A * 1/1965 Reed ..... F42B 14/064 102/522
3,247,795 A * 4/1966 Abela ..... F42B 10/26 102/436
3,613,584 A * 10/1971 Hendricks ..... F42B 7/10 102/439
3,795,196 A * 3/1974 Hillenbrand ..... F42B 12/06 102/518
3,881,421 A * 5/1975 Burczynski ..... F42B 12/34 102/509
3,905,299 A * 9/1975 Feldmann ..... F42B 14/064 102/522
4,136,616 A * 1/1979 Schirneker ..... F42B 12/34 102/510
4,155,308 A * 5/1979 Murawski ..... F42B 14/06 102/520
4,488,491 A * 12/1984 Rhodes ..... F42B 14/064 102/501
4,505,204 A * 3/1985 Wikstrom ..... F42B 14/064 102/523
4,644,865 A * 2/1987 Lawrence ..... F42B 5/067 102/430
4,653,404 A * 3/1987 Halverson ..... F42B 14/068 102/520

(Continued)

*Primary Examiner* — Derrick R Morgan
(74) *Attorney, Agent, or Firm* — Steven Rinehart

(57) ABSTRACT

A projectile comprising a central slug axially circumscribed by a segmented cylindrical sleeve having a plurality of fragmenting segments and a base that opens into an interior cavity. A flange may circumscribe the base. A wad may fill the interior cavity, remaining attached to the central slug. The wad travels with projectile to set a geometric center behind the center of gravity of the projectile. A radially-segmented cylindrical sleeve receives the central slug. The cylindrical sleeve comprises inwardly sloping segments for funneling target material into the recess between the slug and cylindrical sleeve. The segments bend outwardly upon impact and are adapted to bend, compress or flex inwardly to pass through a muzzle choke.

14 Claims, 8 Drawing Sheets

(56) References Cited

U.S. PATENT DOCUMENTS 4,669,385 A * 6/1987 Maki ..... F42B 7/08 102/452
4,676,169 A * 6/1987 Maki ..... F42B 5/02 102/439
4,709,638 A * 12/1987 Broden ..... F42B 14/068 102/522
4,735,147 A * 4/1988 Halverson ..... F42B 14/064 102/520
4,735,148 A * 4/1988 Holtzman ..... F42B 14/064 102/522
4,788,915 A * 12/1988 Sauvestre ..... F42B 10/08 102/439
4,829,904 A * 5/1989 Sullivan ..... F42B 7/10 102/439
5,016,538 A * 5/1991 Sowash ..... F42B 14/064 102/439
5,160,805 A * 11/1992 Winter ..... F42B 10/52 102/507
5,164,539 A * 11/1992 French ..... F42B 14/064 102/442
5,175,394 A * 12/1992 Sowash ..... F42B 14/064 102/522
5,187,325 A * 2/1993 Garvison ..... F42B 12/34 102/501
5,214,238 A * 5/1993 Young ..... F42B 14/064 102/439
5,235,915 A * 8/1993 Stevens ..... C06B 33/00 102/439
5,339,743 A * 8/1994 Scarlata ..... F42B 7/10 102/439
5,477,786 A * 12/1995 Leeker ..... F42B 10/06 102/501
5,479,861 A * 1/1996 Kinchin ..... F42B 14/064 102/439
6,073,560 A * 6/2000 Stone ..... F42B 14/064 102/522
6,105,506 A * 8/2000 Gangale ..... F42B 10/26 102/439
6,148,731 A * 11/2000 Winter ..... F42B 12/34 102/501
6,182,574 B1 * 2/2001 Giannoni ..... F42B 12/34 102/510
6,244,186 B1 * 6/2001 Pichard ..... F42B 6/10 102/501
6,367,387 B1 * 4/2002 Kruper ..... F42B 7/10 102/439
6,814,006 B2 * 11/2004 Johansson ..... F42B 14/068 102/522
7,302,892 B1 * 12/2007 Meyer ..... F42B 7/10 102/522
7,549,376 B1 * 6/2009 Grossman ..... F42B 10/50 102/400
8,438,767 B2 * 5/2013 Rebar ..... F42B 12/34 102/509
9,157,711 B2 * 10/2015 Tresserras Torre ..... F42B 6/10
9,797,696 B2 * 10/2017 Golloher ..... F42B 12/34
2002/0100389 A1 * 8/2002 May ..... F42B 6/10 102/501
2007/0193468 A1 * 8/2007 Sauvestre ..... F42B 5/045 102/501
2009/0064887 A1 * 3/2009 Winter ..... F42B 7/10 102/439
2009/0217838 A1 * 9/2009 Salva ..... F42B 6/10 102/508
2014/0190364 A1 * 7/2014 Peterson ..... F42B 7/08 102/439
2015/0330751 A1 * 11/2015 Flint ..... F42B 12/367 102/507
2015/0354930 A1 * 12/2015 Fricke ..... F42B 12/34 102/439
2017/0299357 A1 * 10/2017 Pierce ..... F42B 12/06

* cited by examiner

FRAGMENTING SHOTGUN PROJECTILE WITH RADIALLY-DISPOSED SEGMENTS

FIELD OF THE INVENTION

This invention relates to a fragmenting firearm projectile with a radially-disposed cylindrical sleeve segmented into fragmenting segments, and more particularly relates to a ballistic projectile that discharges from a shotgun which fragments upon engagement with a target; whereby the projectile provides a central slug having a distal end that initially impacts the target, and a proximal end that terminates at a flange and opens into a cavity; whereby a wad fills the cavity and travels with the projectile before disengaging from the central slug at impact with the target; whereby a radially-segmented cylinder receives the central slug, such that a recess forms between the central slug and an inner surface of the radially-segmented cylindrical sleeve; whereby a base end abuts the proximal end of the central slug; whereby the radially-disposed segments bends outwardly to fragment upon impacting the target or soon after impacting.

BACKGROUND

Description of the Related Art

Typically, a shotgun utilizes a cartridge which commonly has a projectile composed of a multiplicity of small lead pellets or the like which (birdshot or buckshot) which, when propelled out of the weapon, form a shot pattern which has a distinctive shape and size. While forming a shot pattern is well-known. The shot pattern expands as the shotgun pellets travel ever increasing distances away from the firearm.

A slug load of a shotgun for animal hunting or target shooting usually comprises a case with a primer, a powder, an over-powder wad, a wad, and a slug. The powder, the over-powder wad, the wad, and the slug are inserted in the case in this order and the slug is held in the case by a crimp provided on the front open end of the case.

There exist no efficient means of imparting kinetic energy to a target using a shotgun slug. A hollow-point bullet is an expanding and fragmenting bullet that traditionally collapses a cavity in its tip causing the bullet to expand upon entering a target in order to damage more tissue as it travels through the target. Hollow points are designed to increase in diameter once within the target, thus maximizing tissue damage and blood loss or shock, and to remain inside the target, thereby transferring all of the kinetic energy of the bullet to the target.

A hollow point bullets in the art may be solid or jacketed. Solid bullets typically comprise a solid piece of metal, such as lead or copper while jacketed bullets typically comprise a lead core surrounded by a harder, slicker metal such as brass which increases resistance of the bullet to mechanical deformation by the action of the gun as compared to the solid bullet.

Traditional shotgun slugs suffer from a number of inefficiencies including that they do not expand and cause only localized tissue damage. There exists a need in the art for increasing the energy transfer capabilities of a shotgun slug and a shotgun slug which fragmented or expanded would be desirable in the art, including a shotgun slug comprising a number of metal segments forming a cylindrical sleeve around the slug body for mushrooming and fragmenting in tissue.

SUMMARY

From the foregoing discussion, it should be apparent that a need exists for a fragmenting shotgun projectile with radially-disposed segments which can bend inwardly to pass through a choked firearm muzzle, and fragments upon impact with a target. Beneficially, such a projectile would enhance a firearm projectile, and specifically the performance and damage done by a shotgun slug.

The present invention has been developed in response to the present state of the art, and in particular, in response to the problems and needs in the art that have not yet been fully solved by currently available firearm projectiles and shotgun slugs. Accordingly, the present invention has been developed to provide a fragmenting firearm projectile, the projectile comprising: a central slug defining an interior cavity and comprising: an outer sidewall, an inner sidewall, a distal end, and a base, an open bottom end, and a frustoconical tip; a flange extending laterally from the base of the central slug and circumscribing the central slug; and a cylindrical sleeve segmented into a plurality of segments that join approximately at the base end, the segments configured to bend inwardly and outwardly at the base, the segments adapted to fragment away from the central slug upon impact, the segments axially circumscribing the central slug, the segments having a proximal end connected to the base and an opposed distal end; wherein the distal ends of the segments are chamfered to slope inwardly toward the central slug; whereby a recess forms between the cylindrical sleeve and the central slug.

The slug may comprise a distal frustoconical tip. The central slug may rise upwardly to a greater height than the cylindrical sleeve. The distal end of the central slug may comprise a tip.

The cylindrical sleeve is substantially parallel on a lateral axis with the central slug.

The chamfered distal end of the segments may funnels target material into the recess between the cylindrical sleeve and central slug.

The projectile may comprise a shotgun slug.

The projectile may further comprise a ring disposed in the space between the cylindrical sleeve and central slug.

One or more of the slug and segments may comprise a partially-enveloping jacket. One or more of the slug and segments may comprise a fully-enveloping jacket.

The segments may be conjoined at one or more points in between the proximal end and the distal end. The projectile may be forged as a single, integrated piece. In other embodiments, the projectile may be cast as a single, integrated piece.

A fragmenting firearm projectile, the projectile comprising: a central slug defining an interior cavity and comprising: an outer sidewall, an inner sidewall, a distal end, a distal frustoconical tip, and a base, wherein the central slug defines an open bottom; a flange extending laterally from the base of the central slug and circumscribing the central slug; and a cylindrical sleeve segmented into one or more segment(s) that join approximately at the base end, the segment(s) configured to bend inwardly and outwardly at the base, the segment(s) adapted to fragment away from the central slug upon impact, the segment(s) axially circumscribing the central slug, the segment(s) having a proximal end connected to the base and an opposed distal end; wherein the cylindrical sleeve further comprises a flange annularly circumscribing the proximal end of the cylindrical sleeve; wherein the central slug rises upwardly to a greater height than the cylindrical sleeve; wherein the distal ends of the segment(s) are chamfered to slope inwardly toward the central slug.

The segments may be conjoined at one or more points in between the proximal end and the distal end.

A second fragmenting shotgun projectile is also provided, the projectile consisting of: a central slug defining an interior cavity and comprising: an outer sidewall, an inner sidewall, a distal end, a frustoconical tip, and a base; wherein the central slug defines an open bottom end; an uninterrupted flange extending laterally from the base of the central slug and circumscribing the central slug; and a cylindrical sleeve segmented into a plurality of segments that join approximately at the base end, the multiple segments configured to bend inwardly and outwardly at the base, the segments adapted to fragment away from the central slug upon impact, the segments axially circumscribing the central slug, the segments having a proximal end connected to the base and an opposed distal end; a jacket covering the distal end of the central slug; a plurality of jackets enveloping the segments; wherein the cylindrical sleeve further comprises a flange annularly circumscribing the proximal end of the cylindrical sleeve; wherein the central slug rises upwardly to a greater height than the cylindrical sleeve; wherein the distal ends of the segments are chamfered to slope inwardly toward the central slug.

A plurality of separately-manufactured components may be affixed together to form the projectile.

One objective of the present invention is to provide an improved shotgun slug for use in a shotgun cartridge. An object of the present invention is to maximize damage to a target by fragmenting the radially-segmented cylinder upon impact with the target. Another objective is to enable unhindered passage through a choked muzzle by allowing the segments to bend inwardly. Another object of the present invention is to provide an improved shotgun projectile which will travel along the desired trajectory to its target and have a controlled fragmentation upon striking the target.

A further object of the present invention is to provide an improved projectile which will remain intact during its flight to a target and will have a controlled break-up into separate missiles in the internals of an animal, providing greatly increased concussion, shock, and mutilation, whereby the stopping and killing power of the shot is greatly augmented.

Further objects and advantages of this invention will become apparent from the following description referring to the accompanying drawing, and the features of novelty which characterize this invention will be pointed out with particularity in the claims appended to and forming a part of this specification.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
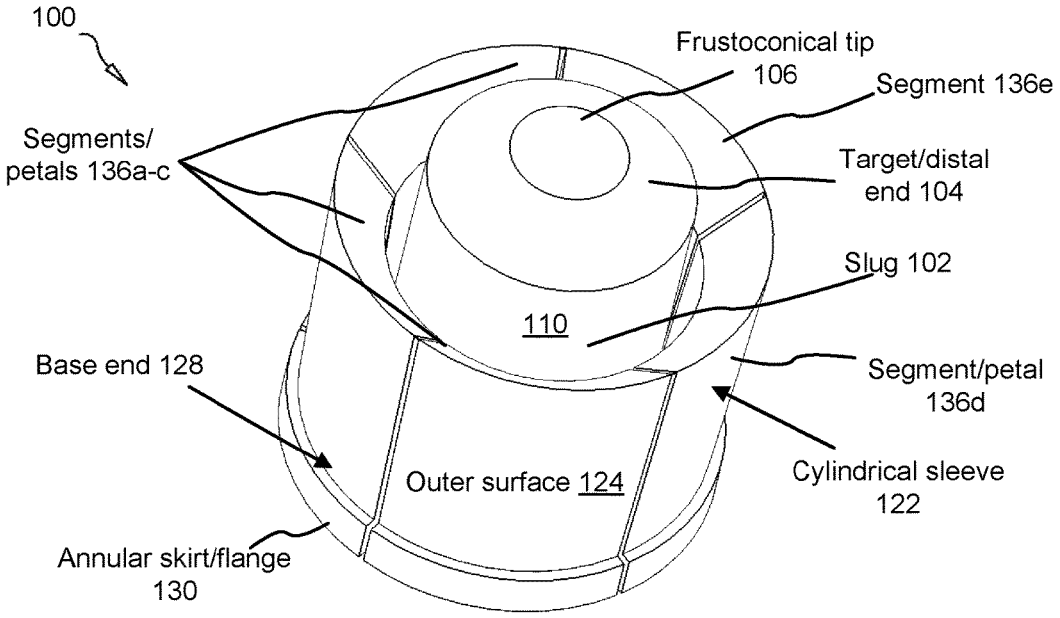
FIG. 1 is a top side perspective angle view illustrating one embodiment of a fragmenting shotgun projectile with radially-disposed segments in accordance with the present invention.

FIG. 1 depicts a fragmenting shotgun projectile with radially-disposed segments 100. The radially-segmented fragmenting firearm projectile 100, hereafter "projectile 100" provides a central slug 102 having a frustoconical tip 106 and a concentrically attached radially-segmented cylindrical sleeve 122 comprising a plurality of segments 136. The projectile 100 is discharged from a firearm such as a shotgun.

The unique features and configuration of the projectile 100 when fired towards a target (not shown). A wad may remain attached to the projectile 100 during travel, so as to improve center of gravity balancing during flight. The segments 136 (or petals 136) bend outwardly upon impart with a target and may flex, compress or bend inwardly to pass through a choked firearm muzzle. Tissue may be funneled into a recess between a central slug 102 and the segments 136*a-e*. The segments 136*a-e* fragment as the central slug 102 continues on its trajectory, so as to optimize damage to the target.

Figure 2:
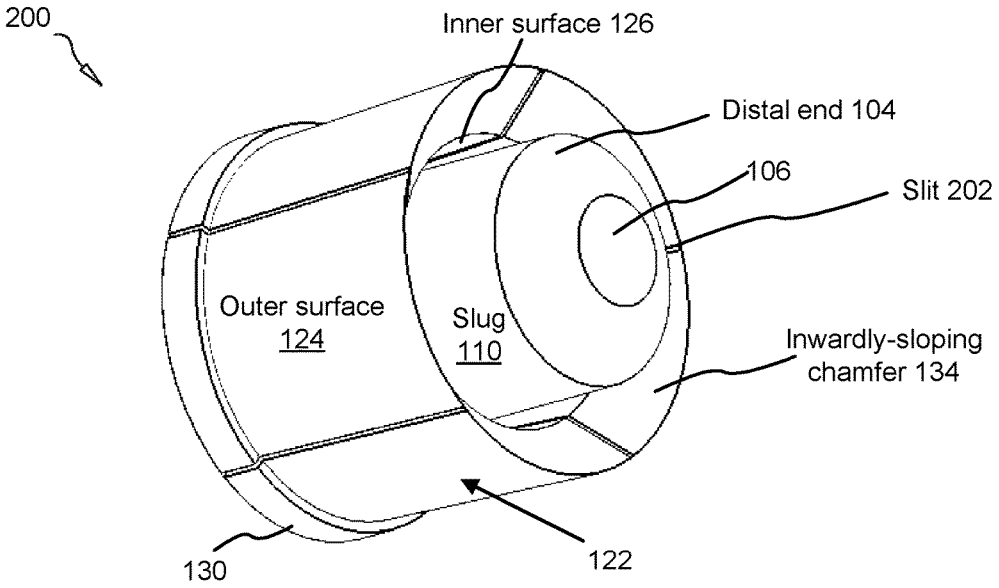
FIG. 2 is a top side perspective left side view illustrating the fragmenting shotgun projectile with radially-disposed segments shown in FIG. 1 in accordance with the present invention.
Figure 3:
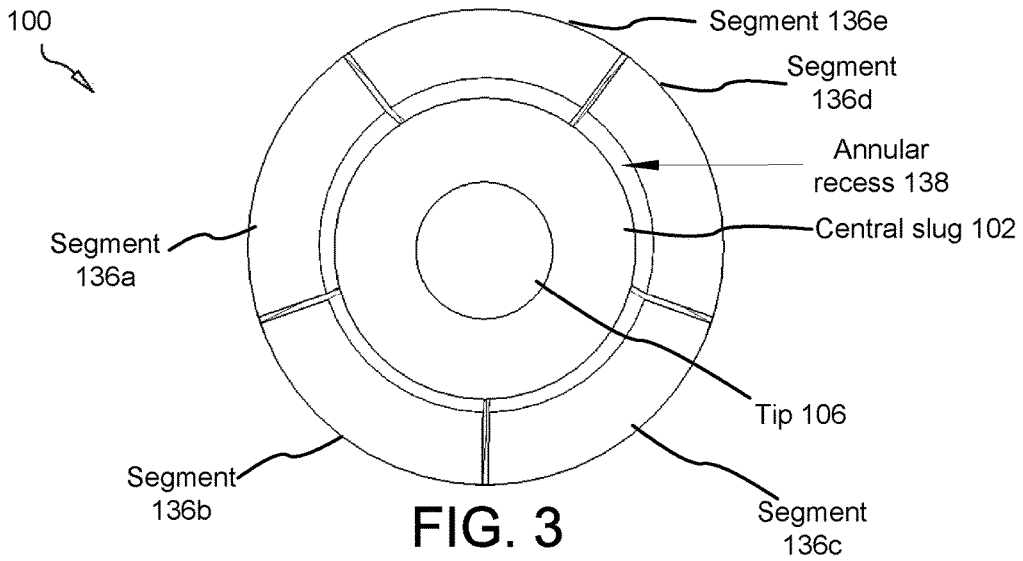
FIG. 3 is a top perspective view illustrating the fragmenting shotgun projectile with radially-disposed segments shown in FIG. 1 in accordance with the present invention.

As referenced in FIG. 2, the projectile 100 provides a central slug 102. The central slug 102 may include a generally cylindrical shape, as those shotgun slugs known in the art are generally designed. In some embodiments, the central slug 102 may have an elongated rectangular shape or may even comprise buckshot. The top view in FIG. 3 shows the central slug 102 having an aerodynamic shape that enhances travel of the projectile 100 including a frustoconical tip 106.

In various embodiments, the cylindrical sleeve 122 comprises a plurality of segments 136. In other embodiments, the cylindrical sleeve 122 comprises a single, uninterrupted segment 136.

The slug 102 (or central slug 102) may include an outer sidewall 110, an inner sidewall 112 (shown in relation to FIGS. 9-10 below), a target end 104 (or distal end 104) and a base 108 at the proximal end of the projectile. The sidewall 110 extends longitudinally between the distal end 104 and the base 108. The distal end 104 of the central slug 102 is the portion of the central slug 102 that initially impacts the target. In one embodiment, the distal end 104 is tapered about 53.7°, but may be tapered by any amount. In another embodiment, the distal end 104 comprises a hard fustoconical tip 106 (also a "semi-wadcutter") that is the initial contact point with the target. The tip 106 may alternatively be shaped in at least one of the following configurations: round nose, hollow point, spitzer (pointed), wadcutter, flat, and the like. In various embodiments of the present invention, the slug 102 comprises a hollow interior cavity and forms a hollow point projectile within the fragmenting cylindrical sleeve 122.

A slit 202 forms between each segment 136 which allows the segment to contract, compress, flex inward, or bend inward when traveling through a choke on a shotgun.

Figure 4:
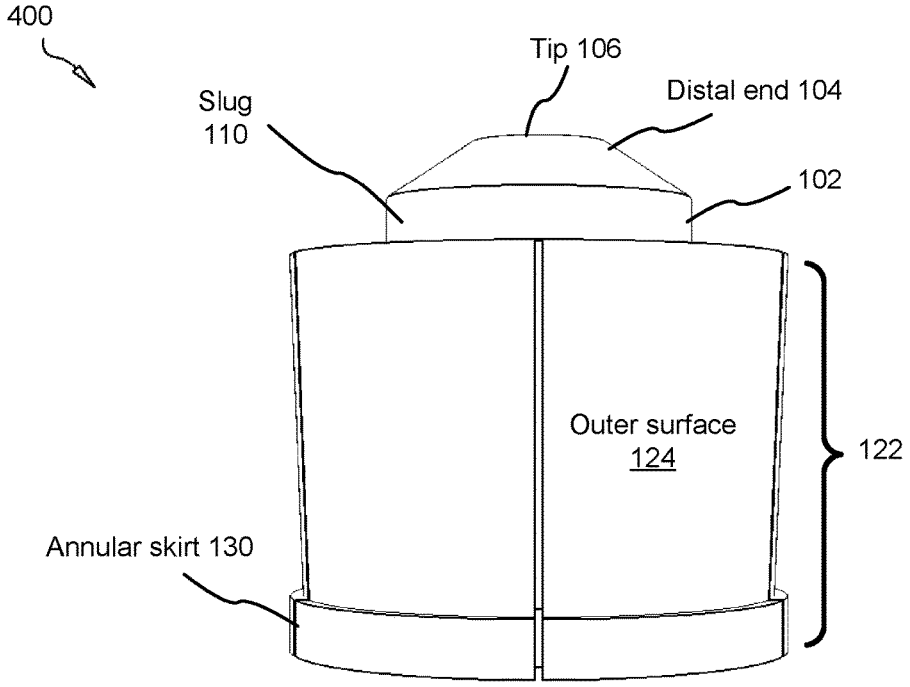
FIG. 4 is a side perspective view illustrating a fragmenting shotgun projectile with radially-disposed segments in accordance with the present invention.

Turning now to FIG. 4, the central slug 102 further comprises a base 108 that is disposed opposite the target end 104. The base 108 is flat, and opens into a cavity 116. In this manner, the central slug 102 is substantially hollow, so that the cavity 116 (further shown and described in relation to FIG. 7) receives a wad.

In some embodiments, a flange or skirt 130 is annularly disposed around the base 108 of the central slug and/or the cylindrical sleeve 122. The flange 130 may extend less than a millimeter from the base 108 or may extend up to 10 millimeters. The flange 130 may sheer off or be swaged into a recess on the wad while in a choke.

A wad may fill a cavity 116 defined by the central slug 102. The wad is useful for separating powder from shots or from projectiles. Further, the projectile 100 may utilize the wad to alter the balance of gravity and create a straighter trajectory.

The position of the wad in the central slug 102 is especially effective because the wad may travel with the projectile 100. The wad creates a geometric center that is further rearward and closer to the base 108. This creates a more forward or distal center of gravity of the projectile 100, which enhances the linear trajectory of the projectile 100 during flight. The wad may disengage from the central slug 102 at impact with the target.

Figure 5A:
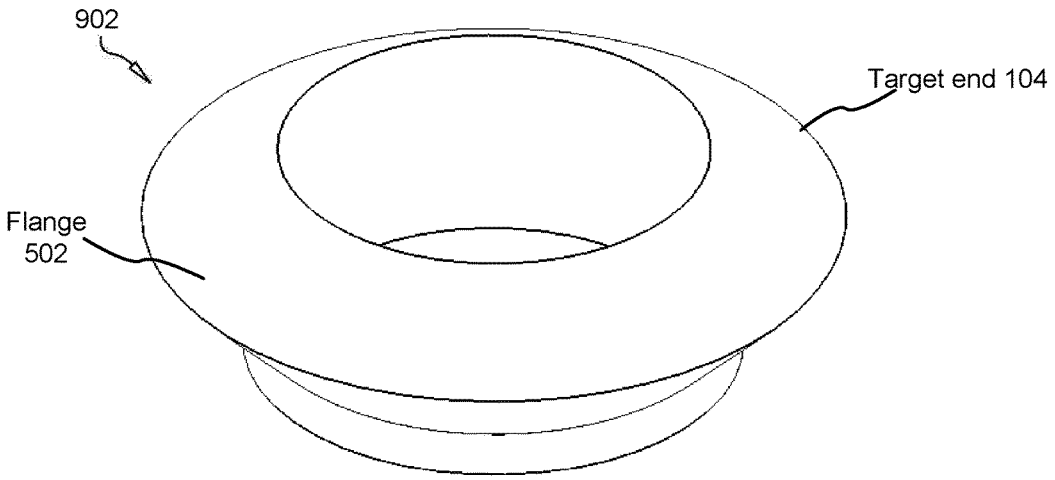
FIG. 5A is a blown up view illustrating an exemplary a ring in accordance with the present invention.
Figure 5B:
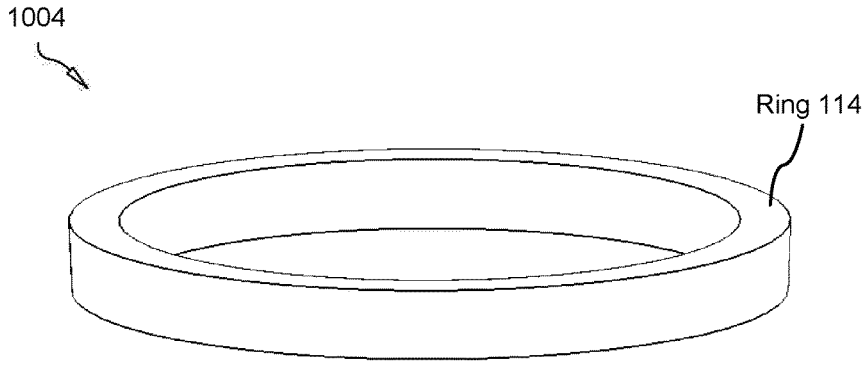
FIG. 5B is a blown up view illustrating an exemplary a ring in accordance with the present invention.

Turning now to FIGS. 5A-5B, FIG. 5A depicts a polymeric ring 902 (further described below) which inserts into the annular recess 138 comprising a flange 502 which abuts the segments 136 in some embodiments.

FIG. 5B depicts a polymeric ring 1004 which inserts into the annular recess 138 in some embodiments.

Figure 6:
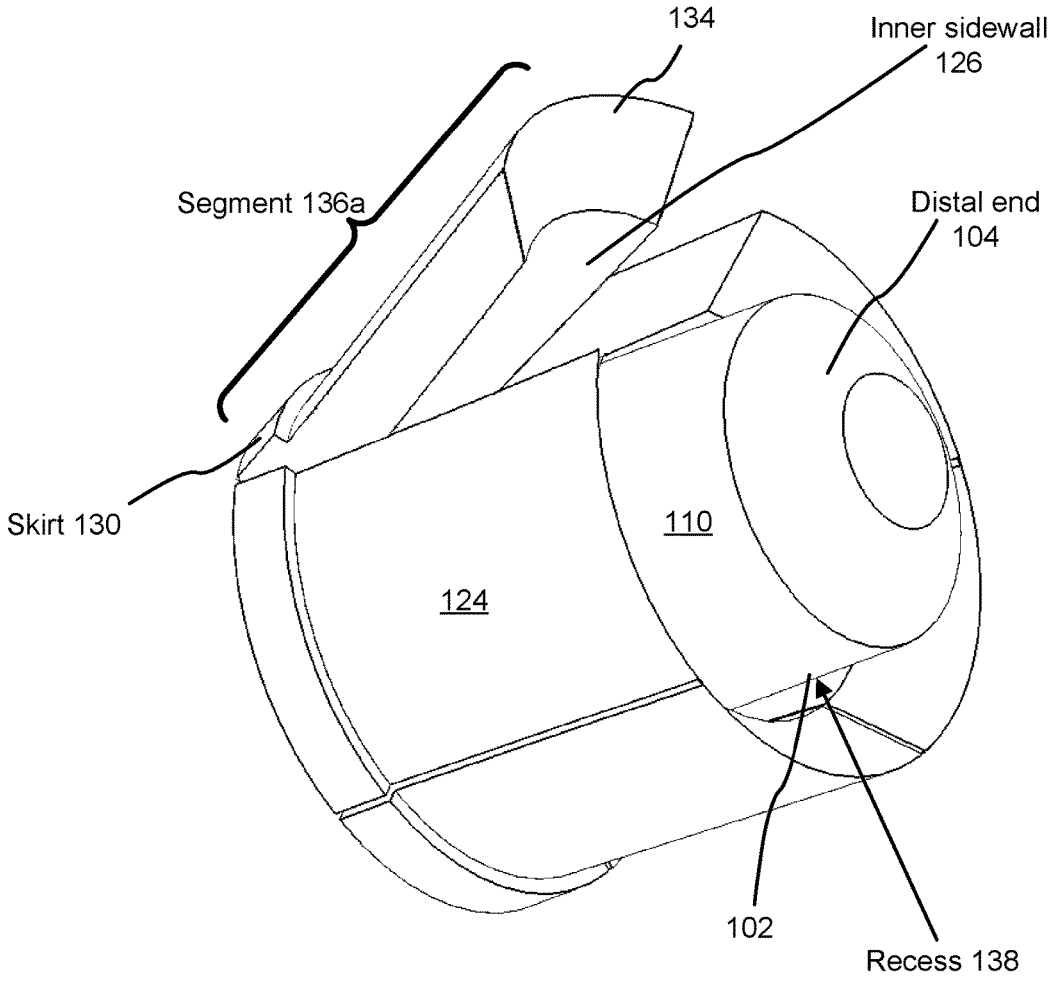
FIG. 6 is side perspective view illustrating a partially-deformed segment away from the fragmenting shotgun projectile in accordance with the present invention.

Looking now at FIG. 6, the projectile 100 provides a radially segmented cylindrical sleeve 122 that receives the central slug 102. In some embodiments, the radially-segmented cylindrical sleeve 122 is disposed longitudinally parallel with the central slug 102. However, in other embodiments, the radially-segmented cylinder 122 deviates slightly away from the central slug 102 about 2.2° or up to 30 degrees. This creates a funnel configuration, as described below. Thus, a concentric arrangement is formed between the radially-segmented cylinder 122 (or cylindrical sleeve 122) and the central slug 102.

The base end 128 may be integrated with the central slug 102. In one embodiment, the base end 128 of the radially segmented cylinder 122 forms an annular skirt 130. The skirt 130 may abut the inner sidewall of a gun barrel as the slug travels through the gun barrel.

In some embodiments, the base end 128 of the radially-segmented cylinder 122 may define or comprise a score along the outer surface for weakening the surfaces 124, 126 of the segmented cylinder 122, so as to enable inward and outward bending of the segments 136*a-e*.

In some embodiments, a recess 138 forms between the cylindrical sleeve 122 and the central slug 102. The recess 138 is useful in that target material may fill the recess 138 so that the segments 136*a-e* expand into fragmentation, as described below. In one embodiment, the recess 138 is a noticeable gap between the central slug 102 and the segments 136*a-e*.

Figure 7:
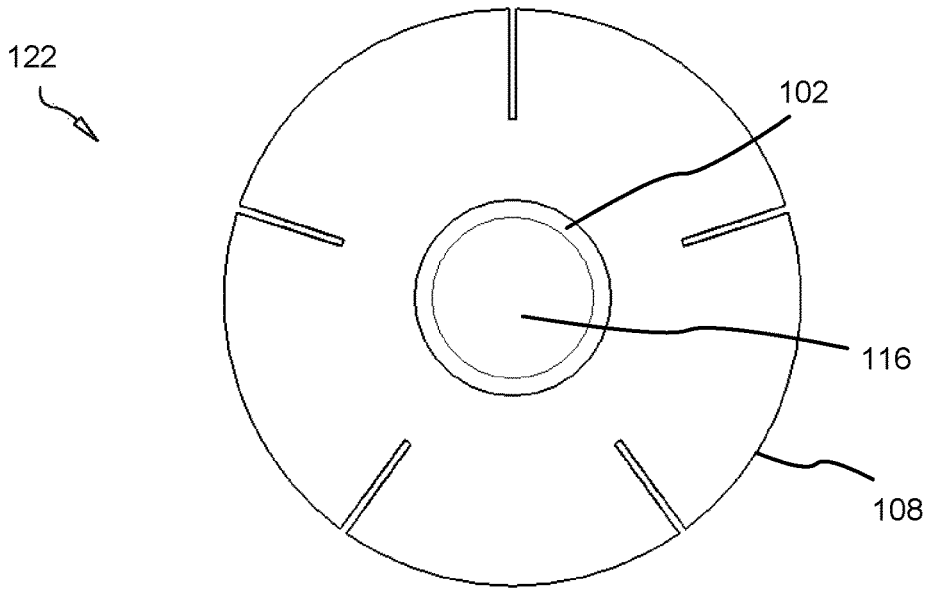
FIG. 7 is bottom perspective view illustrating a fragmenting shotgun projectile with radially-disposed segments in accordance with the present invention.

As shown in FIG. 7, the radially segmented cylinder 122 is segmented into multiple segments 136*a-e* that join approximately at a base end 128 of the radially-segmented cylindrical sleeve 122. The segments 136*a-e* are the component of the projectile 100 that, upon impacting the target, bend outwardly and break away imparting energy into the target and causing more optimal tissue damage.

For example, upon impact with the target, the recess 138 rapidly fills with target material. An exemplary target may include a water base material such as flesh. Thus, the target material can cause hydraulic force to be exerted on the segments 136*a-e*, causing them to flower open and expand within the target. When the segments 136*a-e* expand they stress the base 108 of the cylindrical sleeve 122 until a breaking point has been reached. The segments 136*a-e* may then separate from the central slug 102 and continue deeper into the target upon nonparallel pathways. Furthermore, the central slug 102 continues along the original trajectory before the fragmentation by the segments 136.

The segments 136*a-e* are also configured or adapted to bend inwardly at the base 108. For example, when the projectile 100 passes through a choked muzzle of a firearm, the segments 136 bend or compress inwardly to become smaller for passing through the choke in the muzzle. In one embodiment, five segments 136*a-e* may be disposed in an annular arrangement. Though in other embodiments, more or less than five segments 136*a-e* may be used.

In some embodiments, the tapered, or inwardly-sloped, configuration of the segments 136 works to funnel target material into the recess 138. This is because, as the target end 104 of the central slug 102 impacts the target, a target material, i.e., flesh, fills the space 138 between the cylindrical sleeve 122 and slug 102 and the plurality of segments 136*a-e* expand outwardly, creating fragmentation. This fragmentation function optimizes damage to the target. In one embodiment, the outer surface 124 extends beyond the inner surface 126 of the tapered free end 134. The terminal distal end of the segments 136 may be sharp, flat, or rounded.

Figure 8:
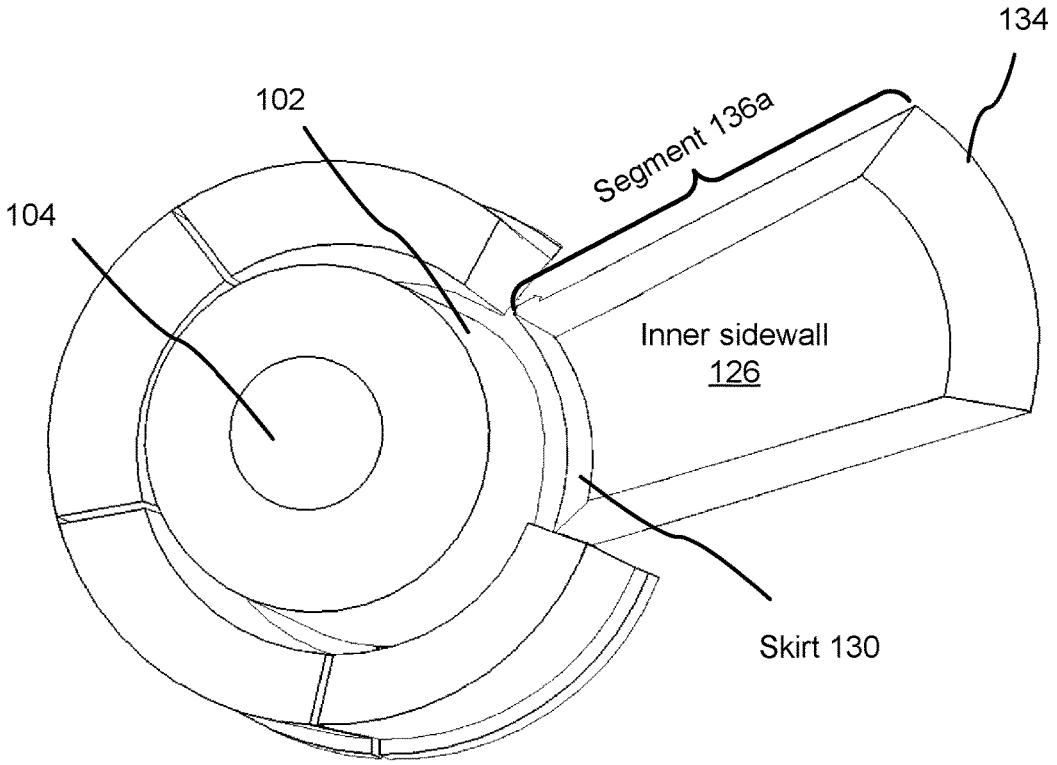
FIG. 8 is top side perspective view illustrating a fragmenting shotgun projectile with radially-disposed segments in accordance with the present invention.

Looking again at FIG. 2, the cylindrical sleeve 122 is generally shorter than the central slug 102, and so the target end 104 of the central slug 102 extends upwardly and beyond the distal end of the segments 136. This allows the tip 106 to engage the target first. Upon impact with the target, the individual segments 136*a-e* bend. The recess 138 between the segments 136*a-e* and the central slug 102 is then filled with target material, so as to fragment and maximize damage to the target, as illustrated in FIGS. 6 and 8. Furthermore, the segments 136*a-e* may also bend inwardly when passing through a choked firearm muzzle.

In one embodiment, the segments 136*a-e* are constructed with a square base 108, and three separate taper points (inner, outer, and point). The tapers are offset by the different or same angle. The outer taper starts at the inner surface 126 of the cylindrical sleeve 122 and is angled out so the terminus of the distal end is aligned with the outer portion of the outer surface 124.

Figure 9:
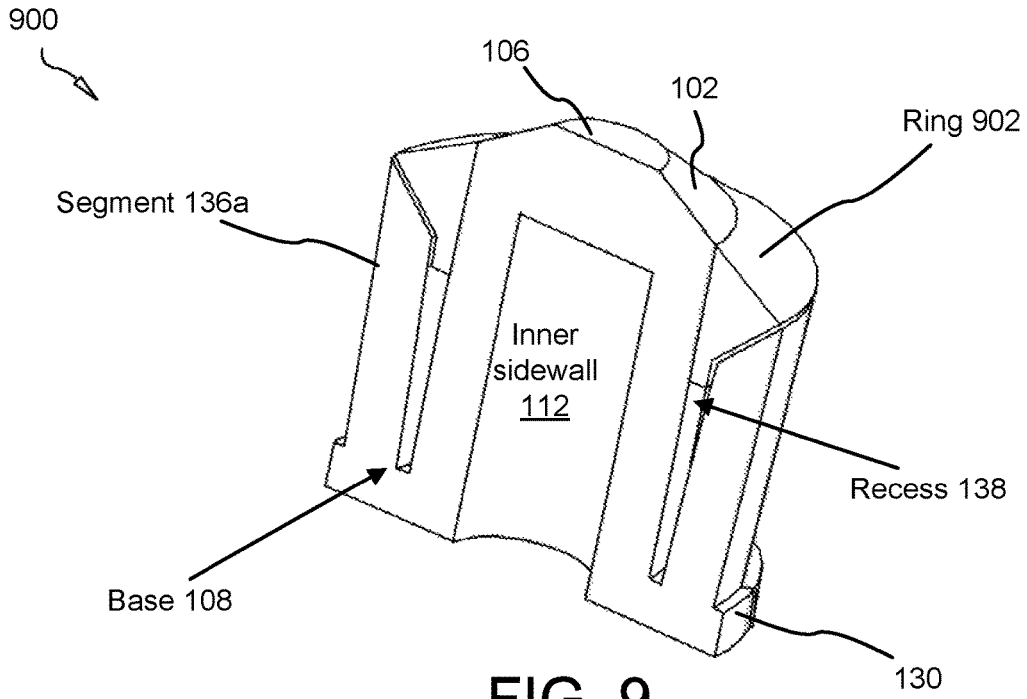
FIG. 9 is a sectioned view illustrating a side perspective view of a fragmenting firearm projectile with a ring disposed between the radially segmented cylinder and the central slug, in accordance with the present invention.

As shown in FIG. 9, a ring 902 is disposed in the recess 138 between the outer sidewall 110 of the central slug 102 and the inner surface 126 of the cylindrical sleeve 122. The placement of a ring 902 between the central slug 102 and the cylindrical sleeve 122 helps to improve the aerodynamics of the projectile 100, and also helps prevent the segments 136*a-e* from bending and taking the projectile 100 out of round if dropped. Upon impact the second embodiment of the ring 1004 pushes the segments 136*a-e* out until target material funnels in the recess 138 between the central slug 102 and the segments 136*a-e*, to break apart.

In one embodiment, the ring 902 may include a plastic ring 902 that is disposed between the central slug 102 and the segments 136*a-e* to improve the aerodynamics of the projectile 100, and to help prevent the segments 136*a-e* from bending if dropped.

Figure 10:
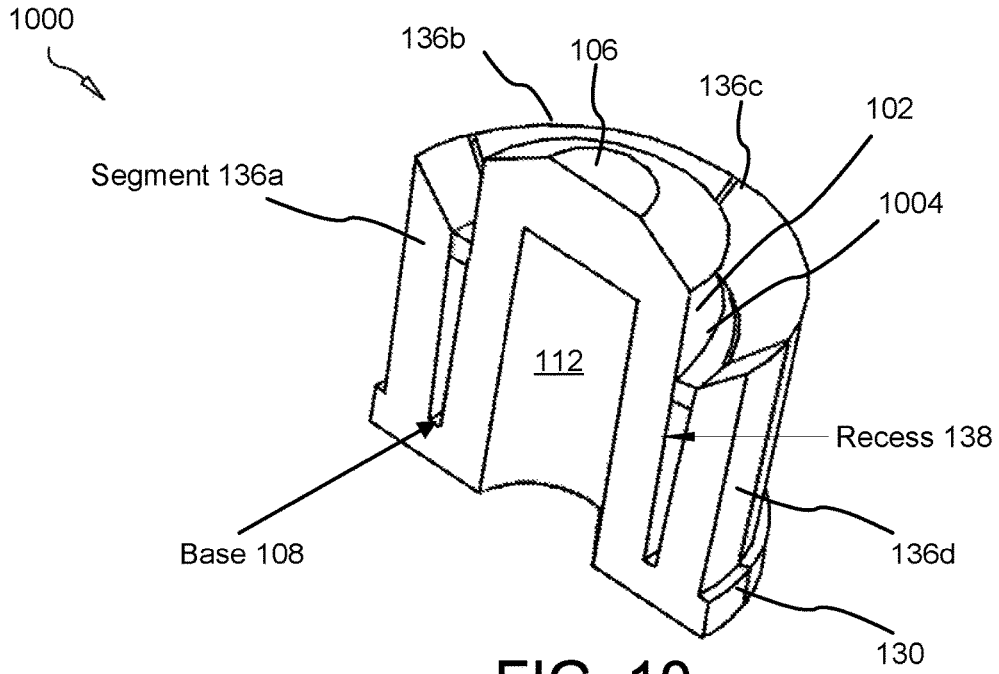
FIG. 10 is a sectioned view illustrating a side perspective view a fragmenting firearm projectile with a secondary embodiment of a ring disposed between the cylindrical sleeve and the central slug in accordance with the present invention.

FIG. 10 shows a second embodiment of a ring 1004 that is disposed between the central slug 102 and the segments 136*a-e*. The second embodiment of the ring 1004 provides a safety feature. Here, the ring 1004 works to keep segments 136 in place if the projectile is dropped.

Figure 11:
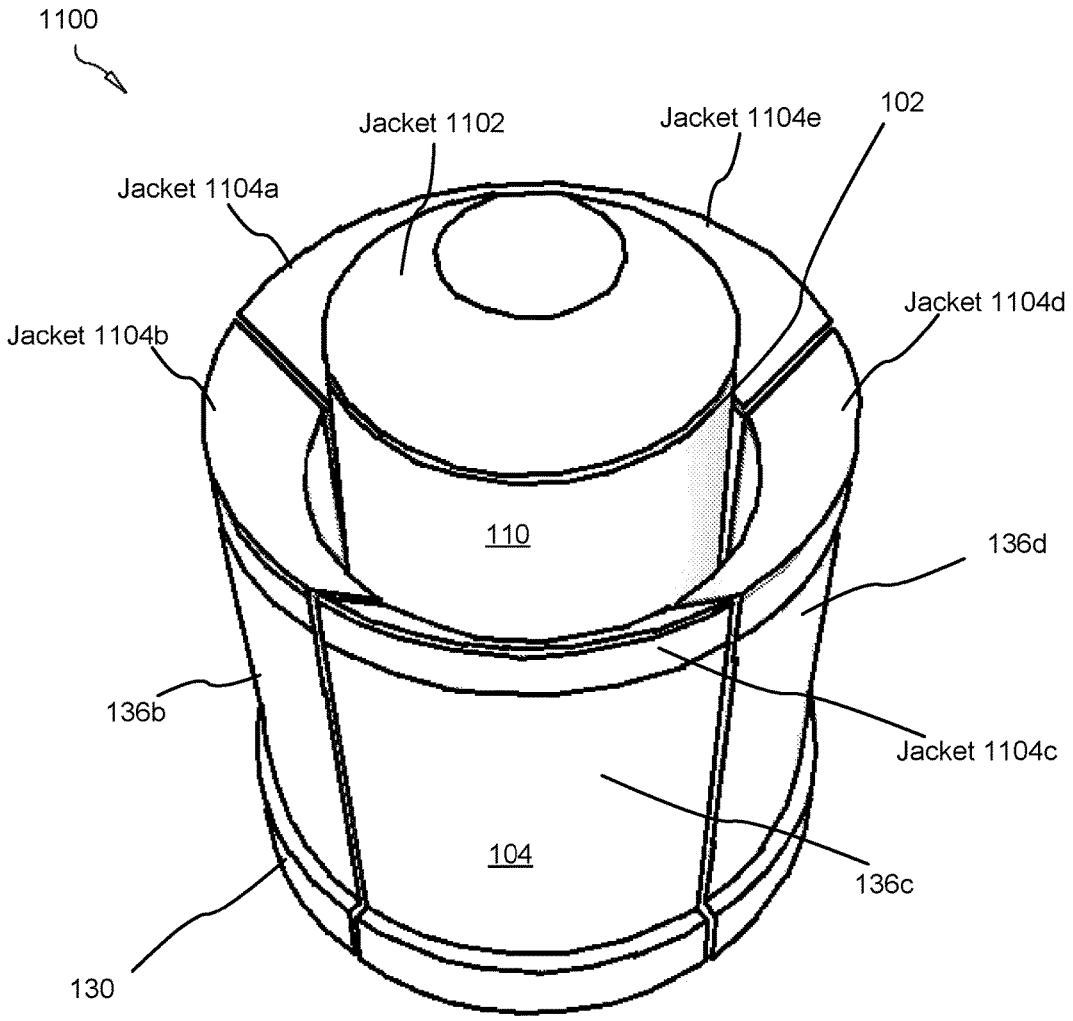
FIG. 11 is a top side perspective view illustrating a radially-segmented fragmenting firearm projectile with a jacket partially-enveloping covering the tip and distal ends of the segments in accordance with the present invention.

In one embodiment, multiple jackets 1104*a-e* encase the segments 136 of the cylindrical sleeve 122 (FIG. 11). The jackets 1104*a-e* (or crowns 1104*a-e*) provide a protective cover that enhances the structural integrity of the cylindrical sleeve 122, and specifically the segments 136*a-e* thereof. In some embodiments, the jackets 1104*a-e* may include polymeric and/or metal alloys. The segments 136 may be fully or partially jacketed.

Figure 12:
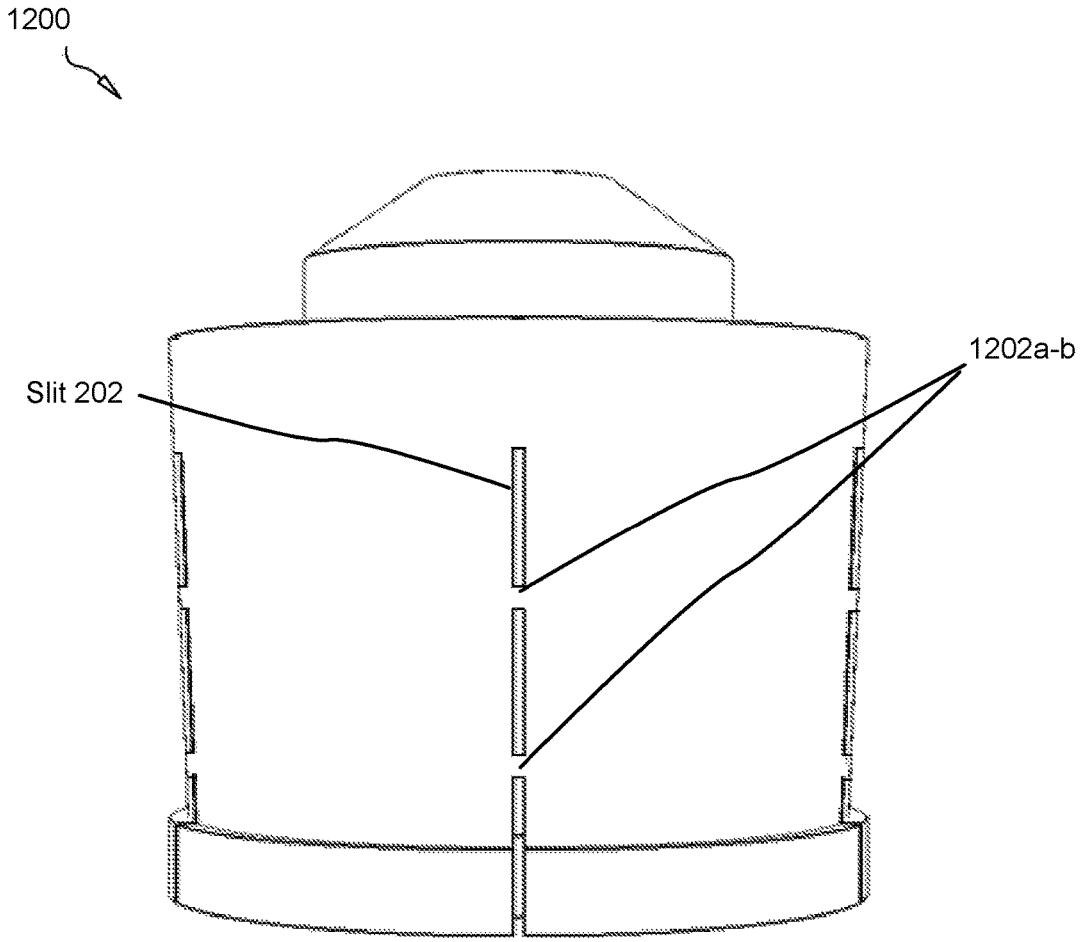
FIG. 12 is a side perspective view illustrating a radially-segmented fragmenting firearm projectile in accordance with the present invention.

FIG. 12 is a side perspective view illustrating a radially-segmented fragmenting firearm projectile 1200 in accordance with the present invention.

The projectile 1200 in the shown embodiment comprises segments 136 conjoined at a plurality of points 1202 between the distal and proximal ends of the projectile 1200. In this manner, the slits 202 formed by the cylindrical sleeve 122 are scored or perforated.

The term "firearm" as described herein refers to pistols, rifles, muzzleloaders, air guns including pneumatically-powered and gas-powered air guns, and any other gun or weapon commonly associated with "firearm."

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A fragmenting firearm projectile, the projectile comprising:

a central slug defining an interior cavity and comprising:
- an outer sidewall,
- an inner sidewall,
- a distal end, and a base,
- an open bottom end, and
- a frustoconical tip;

a flange extending laterally from the base of the central slug and circumscribing the central slug; and a cylindrical sleeve segmented into a plurality of segments that join approximately at the base end, the segments configured to bend inwardly and outwardly at the base, the segments adapted to fragment away from the central slug upon impact, the segments axially circumscribing the central slug, the segments having a proximal end connected to the base and an opposed distal end;

wherein a gap forms between each segment adapted to allow the segment to flex inwardly when traveling through a choke of a shotgun;

wherein the distal ends of the segments are chamfered to slope inwardly toward the central slug;

whereby a recess forms between the cylindrical sleeve and the central slug.

2. The projectile of claim 1, wherein the slug comprises a distal frustoconical tip.

3. The projectile of claim 1, further comprising a wad disposed in the cavity.

4. The projectile of claim 1, wherein the central slug rises upwardly to a greater height than the cylindrical sleeve.

5. The projectile of claim 1, wherein the distal end of the central slug comprises a tip.

6. The projectile of claim 1, wherein the cylindrical sleeve further comprises a flange annularly circumscribing the proximal end of the projectile.

7. The projectile of claim 1, wherein the cylindrical sleeve is substantially parallel on a lateral axis with the central slug.

8. The projectile of claim 1, wherein the chamfered distal end of the segments funnels target material into the recess between the cylindrical sleeve and central slug.

9. The projectile of claim 1, wherein the projectile is a shotgun slug.

10. The projectile of claim 1, further comprising a ring disposed in the space between the cylindrical sleeve and central slug.

11. The projectile of claim 1, wherein each of the segments are conjoined at a plurality of points with two adjacent segments in between the proximal end and the distal end.

12. The projectile of claim 1, wherein the segments deviate away from longitudinal parallel with the central slug at between 0 and 30 degrees.

13. The projectile of claim 1, wherein the gaps extend from a top edge of the distal end of the segments to the proximal end of the segments and into the base.

14. A fragmenting firearm projectile, the projectile comprising:

a central slug defining an interior cavity and consisting of:

an outer sidewall, an inner sidewall, a distal end, and a base, an open bottom end, and a frustoconical tip;

a flange extending laterally from the base of the central slug and circumscribing the central slug; and a cylindrical sleeve segmented into a plurality of segments that join approximately at the base end, the segments configured to bend inwardly and outwardly at the base, the segments adapted to fragment away from the central slug upon impact, the segments axially circumscribing the central slug, the segments having a proximal end connected to the base and an opposed distal end;

wherein a slit forms between each segment adapted to allow the segment to flex inward when traveling through a choke of a shotgun;

wherein the distal ends of the segments are chamfered to slope inwardly toward the central slug;

whereby a recess forms between the cylindrical sleeve and the central slug.

* * * * *